United States Patent [19]

Spirig

[11] 4,361,351

[45] Nov. 30, 1982

[54] MANUALLY CLOSABLE SEAL

[75] Inventor: Walter Spirig, Diepoldsau, Switzerland

[73] Assignee: Stoba AG, Horn, Switzerland

[21] Appl. No.: 157,665

[22] Filed: Jun. 9, 1980

[30] Foreign Application Priority Data

Jun. 29, 1979 [CH] Switzerland ..... 6080/79

[51] Int. Cl.[3] ..... B65D 33/34

[52] U.S. Cl. ..... 292/321

[58] Field of Search ..... 292/317, 318, 321, 322

[56] References Cited

U.S. PATENT DOCUMENTS

| | | | |
|---|---|---|---|
| 736,682 | 8/1903 | Brooks | 292/318 |
| 783,047 | 2/1905 | Kachel | 292/318 |
| 853,240 | 5/1907 | Harris | 292/321 |
| 1,012,882 | 12/1911 | Martineau et al. | 292/318 |
| 1,026,701 | 5/1912 | Reid | 292/318 |
| 1,930,559 | 10/1933 | Keidel | 292/322 |

FOREIGN PATENT DOCUMENTS

| | | | |
|---|---|---|---|
| 587530 | 5/1977 | Switzerland | 292/317 |

*Primary Examiner*—Richard E. Moore
*Attorney, Agent, or Firm*—Werner W. Kleeman

[57] ABSTRACT

A seal body formed of a pot-shaped element or housing and a cover contains a compartment within which there is inserted a holder. The holder comprises a substantially U-shaped metallic element having leg members from which protrude resilient tongues directed away from the holder ends towards the center region of the holder. The tongues extend at an inclination towards the oppositely situated holder leg or leg member. For each leg member there are provided two tongues and, in each case, one of the tongues of one of the leg members intersects, in the hollow space between the leg members, with one of the tongues of the other leg member and forms a locking or blocking element. Coacting with such locking element are catch elements provided at both ends of a metallic strip. These catch elements are formed by openings. If one end of the strip is introduced into a receiving opening of the seal body and which opening is accommodated to the dimension of the strip end, and into the space between the leg members of the holder, then the opening is caught at the tongues of the one locking element and no longer can be retracted. To close the seal the other end of the metallic strip is guided into the seal body between the tongues of the other locking element until it is irreversibly caught by means of its strip opening in the same manner.

8 Claims, 2 Drawing Figures

MANUALLY CLOSABLE SEAL

BACKGROUND OF THE INVENTION

The present invention relates to a new and improved construction of a manually closable seal useful for closing the most different types of containers, packages, compartments, storage areas and so forth.

Generally speaking, the manually closable seal of the present invention is of the type comprising a seal body through which extends a channel or compartment. Within such channel there is mounted a holder for the retention of one end of a flexible strip, the other end of which is structured as a catch element. The catch element is designed to coact with locking elements arranged at the holder within the seal body.

Manually closable seals of this type are known under the designation "freight-car seals". They are employed for security reasons in conjunction with closure or locking devices for the most varied articles, wherein typically openings of the closure devices, in the closed position, overlap, so that the seal strip anchored at one end in the seal body can be introduced by means of its other end through these openings. Thereafter, the free end of the strip is introduced into the seal body, with the catch element irreversibly catching in the locking element, so that reopening of the closure which has been sealed in this manner only can be accomplished through destruction of the seal.

Such securing of a closure or lock is desired in many instances or, in fact, even prescribed by regulations or law, such as for instance in conjunction with closures for bags or sacks, especially mail pouches, for the sealing of the freight compartments of vehicles and so forth.

A safety seal of the previously mentioned type is known from Swiss Pat. No. 481,444. With this state-of-the-art seal the seal body is fabricated of one piece of a plastics material and extending therethrough is a channel having smooth walls. This channel constricts internally of the seal body while forming a step. The holder of the seal contains a locking element and is in the form of a metallic part. Such holder together with the end of a strip formed of plastic and secured to such holder, can be inserted from the side of the larger channel opening, together with the locking element leading, into the seal body. The step or stepped region within the channel serves as a stop, in order to prevent that the holder will move out of the seal body in the insertion direction. At the same time elements provided at the holder and effective in a direction opposite to the insertion direction, prevent undesirable departure of the inserted holder from the seal body.

This prior art seal, while relatively simple to fabricate, consisting of only three parts, nonetheless its handling requires a certain dexterity, in order to ensure that the individual parts are assembled in the correct position and sequence and to avoid faulty sealing. But in particular, however, this seal can no longer fulfil the strenuous requirements imposed upon the safeguarding against fake sealing which is possible at the present time through the use of suitable means employed by thieves and other unlawful intruders. It has been found that such individuals have been able to develop techniques by means of which it is possible for them to open and again close such prior art seals employing strips and catch elements formed of plastic, without visibly damaging the security seal.

Therefore, in practice, the tendency has been to return to the use of prior seal constructions of this type as have been disclosed, for instance, in Swiss Pat. No. 235,982 and the related Swiss Patent of Addition No. 244,992. The seal structures described in these patents have the strip formed by a braided wire. The base of the seal body possesses two tandemly arranged bowed-out portions or protuberances, at the shorter one of which there comes to bear the end knot of the wire which is secured at a flat locking disc, whereas in the longer protuberance there comes to bear a wire eyelet serving as a catch element and provided at the other end of the wire. This wire eyelet is then located adjacent a resilient tongue located at the locking disk and coming into engagement therewith and functioning as a counterlock. This prior art type of seal, while fulfilling all of the security requirements, nonetheless consists of a relatively large number of metallic parts. Hence, its assembly is difficult to carry out and, in part, cannot be automated. The thus required manual work needed for the assembly of such seal renders the same unsuitable for inexpensive mass production, as the same would be needed for such a mass produced and throwaway article.

SUMMARY OF THE INVENTION

Therefore, with the foregoing in mind it is a primary object of the present invention to provide a new and improved construction of manually closable seal of the character described which is not afflicted with the aforementioned drawbacks and limitations of the prior art proposals.

Another and more specific object of the present invention aims at the provision of a new and improved construction of manually closable seal which, on the one hand, consists of very few parts, all of which can be fabricated in a simple and completely automated fashion, wherein the seal can be assembled quickly, in an error-free or faultless fashion and fully automated, but nonetheless at the same time is also constructed such that even when handled by unskilled persons there cannot arise any faulty sealing and the seal, once closed, cannot be opened without visible destruction of the seal.

Still a further significant object of the present invention aims at the provision of a new and improved construction of manually closable seal which is relatively simple in construction and design, economical to manufacture and assemble, extremely easy to use, and makes it virtually impossible to open the seal without visibly destroying or tampering therewith such that the unauthorized opening of the seal can be easily discerned.

Now in order to implement these and still further objects of the invention, which will become more readily apparent as the description proceeds, the manually closable seal of the present development is manifested by the features that the strip or strip element comprises a metallic band or a metallic wire, provided at its ends with a respective opening forming a catch element. The holder or holder element comprises a substantially U-shaped metallic part having legs or leg members. Protruding from these leg members are resilient tongues or equivalent structure which are directed opposite to the holder ends towards the central region of the holder and at an inclination with respect to the oppositely situated leg member. These tongues constitute irreversible locking elements for the catch elements of the strip which are introduced from both sides into the channel of the seal body between the legs or leg members of the holder.

Due to its symmetrical construction as a double open-ended receiver for the strip ends the holder can be inserted in any desired position into the seal body, while still fulfilling its function at all times. This renders possible automation of the assembly and/or facilitates the complete or partial manual assembly work.

The strip can be fabricated independent of the seal body in an inexpensive manner, in random length, preferably by means of a punching operation.

The seal, depending upon the requirements, can be delivered in a semi-assembled condition, in other words, the seal body and the strip can be separated from one another. This affords the possibility of numbering or otherwise appropriately marking the strip at the site of use of the seal, for instance during a working operation which is associated with sealing of the object or the like.

For the finished assembly of the seal it is sufficient to insert the strip at one end into one of both openings of the closed seal body until the tongues catch at the related opening. It is immaterial into which of both openings the strip end is inserted. For purposes of closing the seal then the other end of the strip is simply inserted into the other opening of the seal body until the opening at such strip end becomes caught at the remaining tongues of the holder.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
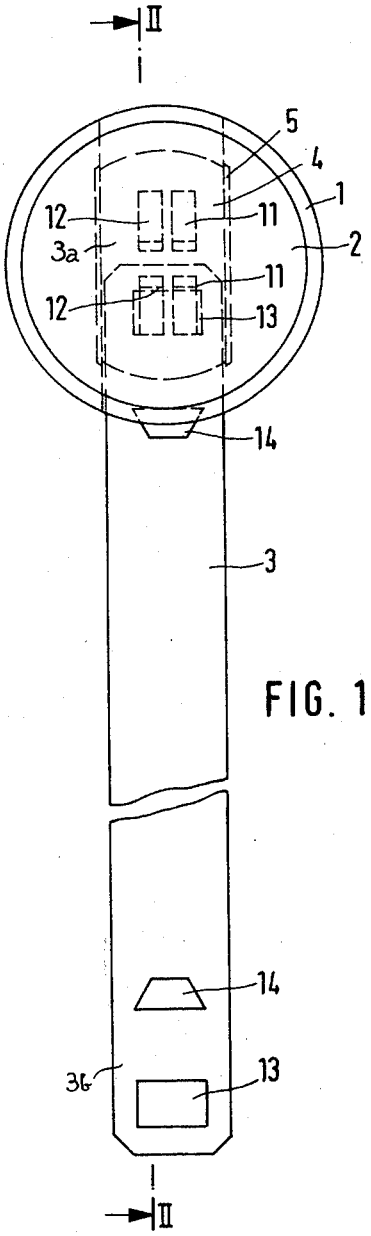
FIG. 1 is a top plan view of a finished assembled, but not yet closed security or safety seal constructed according to the invention.

Describing now the drawings, the illustrated exemplary embodiment of safety or security seal will be seen to comprise a total of four parts or components, namely a pot-shaped element or housing 1, a cover or cover member 2 for the pot-shaped housing 1, a strip or strip element 3 and a holder or holder member 4. It is to be expressly understood that in the context of this disclosure the term "strip", or equivalent expression, is intended to encompass not only band-like elements but also wire-like elements.

The upwardly open, circular disk-shaped housing or pot 1, which may be formed of any suitable plastics material or metal, comprises a chamber or compartment 5 within the seal channel 5*a*. Merging with the chamber or compartment 5, in the direction of one of the diameters of the circular disk-shaped housing 1, are slot-shaped openings 6 and 7 which are closed at all sides and open from both ends of such diameter into the chamber 5. These slot-shaped openings 6 and 7 are conformed to the dimensions of the cross-section of the strip 3.

A shoulder or stepped portion 8 formed in the pot-shaped housing 1 constitutes a substantially ring-shaped contact or support region for the cover member 2, by means of which the seal body, generally indicated by reference character 50, can be closed with the exception of the slot-shaped openings or slits 6 and 7. Also the cover member 2 can be formed of a suitable plastics material or metal and its connection with with pot-shaped housing 1 can be accomplished in any suitable fashion, for instance by welding, for example ultrasonic welding, by an adhesive bond, or in any other appropriate manner.

Prior to closing the pot-shaped housing 1 by means of the cover member 2 the holder or holder member 4 is inserted into the chamber 5 however during the assembly of the seal. This holder 4 comprises a substantially U-shaped metallic element or part which can be easily fabricated by a simple punching and bending operation. The holder 4 and the chamber 5 are dimensioned such that the holder 4 only can be inserted into the chamber or compartment 5 in a manner such that the lateral or end openings 5*b*, between both of the legs or leg members 9 and 10 of the holder 5, are directed towards the slot-shaped openings or slits 6 and 7. The ends 15 and 16 of the holder legs or leg members 9 and 10, and which bound such end openings or apertures 5*b* of the holder 5, additionally are flexed towards one another at right angles with respect to the holder legs 9 and 10 in a manner such that they form a related slot 17 in the seal body which is limited to the dimensions of the slot-shaped openings 6 and 7. After the insertion of the holder or holder member 4 and the mounting of the cover member 2 the holder member 4 is non-displaceably retained in its position. Two resilient tongues or latching elements 11 or equivalent structure protrude from the leg member 9 of the holder 4 in a direction away from the holder ends 15 and 16, towards the center of the holder 4. Further, it will be seen that these two protruding resilient tongues 11 extend obliquely or at an inclination towards the oppositely situated leg or leg member 10 of the holder 4, as best seen by referring to FIG. 2. In the same manner, but however offset with respect to the tongues 11 along the height or width of the other leg 10, there also protrude from this leg 10 of the holder 4 two resilient tongues or latching elements 12 or equivalent structure which, here also, are directed opposite to the holder ends 15 and 16 towards the center of the holder 4. In analogous fashion these two resilient tongues 12 extend obliquely or at an inclination towards the oppositely situated leg 9 of the holder 4. These tongues 11 and 12 are advantageously cut-out at three sides from the material of the related holder leg 9 and 10 and bent out of the plane of the corresponding leg.

Figure 2:
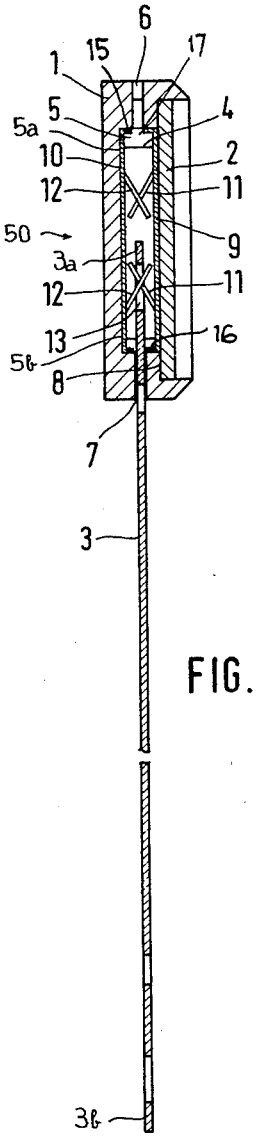
FIG. 2 is a sectional view of the security seal shown in FIG. 1, taken substantially along the line II—II thereof.

Hence, as best seen by referring to FIG. 2 there is thus formed at each half of the holder 4 a respective locking or blocking element, constituted by a tongue 11 and a coacting tongue 12, these coacting tongues 11 and 12 intersecting at the space or region between the holder legs 9 and 10.

Cooperating with these locking elements 11, 12 are the ends 3*a* and 3*b* of the fourth part of the described seal, namely, the ends of the strip 3. These strip ends 3*a* and 3*b* are structured as catch elements. The strip 3, in the embodiment under discussion, is constructed as a metallic band, although as stated conceptually strip 3 also can be considered to be a wire or wire-like element. This metallic band can be fabricated completely automated in random length in a most simple manner and independent of the remaining parts of the seal. As the catch elements there are punched or otherwise formed at the strip 3, specifically at both ends 3*a* and 3*b* of such strip, a respective opening or aperture 13 here shown of essentially rectangular configuration. When the strip 3 is formed as a simple or double twisted circular wire, then in such case there can be secured to the wire ends appropriately formed attachment parts, such as sheet metal parts having provided thereat the catch openings 13 or equivalent structure.

As will be readily apparent and understood from the illustration of FIGS. 1 and 2, during the insertion of any given end of the strip 3 into a random one of both of the openings or slots 6 and 7 of the closed seal body 50, both of the tongues 11 and 12 of the closest situated tongue pair, with respect to the related inserted strip end, will be spread apart by the end surface or edge of the inserted strip end. Thereafter, the spread apart tongues 11 and 12 resiliently engage through the related catch opening 13 of the strip end, returning back into their original position, as such has been illustrated in FIG. 2 for the one strip end 3*a* which has been received in the seal body 50. The strip or strip element 3 now cannot be retracted any more out of the seal body 50. To undertake sealing of a related article or object, the still free strip end, here the strip end 3*b*, is now guided through openings of the article which is to be sealed and after bending back such strip end the latter is then pushed into the free slot-shaped opening, either the opening 6 or 7, as the case may be, and in this instance the opening 6 of the seal body 50 until the catch opening 13 of such strip end 3*b* has caught, in the same manner as the other strip end 3*a*, at the other pair of tongues 11 and 12 of the holder 4. With this operation the seal is now closed and no longer can be opened without destroying such seal. Since the openings 6 and 7 have been coordinated to the thickness and width of the strip or strip element 3, it is equally not possible to again spread apart the tongues 11, 12 by inserting a tool through one or the other of these openings 6 and 7. By virtue of the flexed ends 15 and 16 of the legs 9 and 10 of the holder 4 it is also not possible to improperly open the seal by heating the seal body 50, which may be formed of plastic, and thus any possible enlargement of the slot-shaped openings 6 or 7 due to such heating nonetheless will not enable insertion of a tool into holder 4.

As an additional measure which can be beneficially provided in order to provide instant recognition of possible unauthorized manipulations which have been carried out at the closed seal, there are beneficially provided cut-out portions 14 forming reference fracture locations, at the strip ends 3*a* and 3*b*. These cut-out portions 14 are located in spaced relation from the corresponding end 3*a* and 3*b* of the strip 3 such that when the strip 3 is engaged at both ends with the seal body 50 such cut-out portions are located just within the outer edge of the seal body 50, as best seen by referring to FIG. 1. Hence, if during unauthorized manipulations at the closed seal the strip 3 breaks at this location, then the broken-off seal end, such as the seal end 3*a*, remains within the seal body 50 and prevents the renewed introduction of a strip for the purpose of making it appear that the seal is still closed, i.e. forming a so-called apparent or false seal.

As will be readily evident from the previous description, the seal of the present development fulfils all of the requirements as concerns security, convenient handling and suitability for mass production. Depending upon requirements, the seal can be delivered in a semi-assembled condition to the user, i.e. the seal body and strip are separated from one another. This enables the user to first then mark the strip directly prior to its use, thereby enhancing the security aspects of the seal.

During the assembly of the seal body, assembly errors are practically eliminated, because the holder, regardless in which position it is inserted into the pot-shaped housing 1, always will fulfil its function. Also upon handling of the seal by relatively unskilled individuals it is likewise practically impossible for faulty manipulations to arise, since the strip can be inserted at each end into each opening of the seal body and thus can be irreversibly secured therein.

While there are shown and described present preferred embodiments of the invention, it is to be distinctly understood that the invention is not limited thereto, but may be otherwise variously embodied and practised within the scope of the following claims. Accordingly,

What I claim is:

1. A manually closable seal comprising:

means defining a seal body containing therein a channel;

a strip element having symmetrically formed opposed ends;

each of said opposed ends being provided with an opening constituting a respective catch element intended to lockingly cooperate with a holder;

a holder structured to be capable of being correctly mounted in said channel in a plurality of different positions and intended to receive at opposed ends thereof, in coacting relationship therewith, one opposed end of each of said opposed ends of said strip element;

said holder comprising a substantially U-shaped metallic element having symmetrically arranged oppositely situated leg members;

said metallic element of said holder having opposed holder ends;

resilient tongues provided at each of said leg members and extending away from said holder ends towards a central region of said holder and at an inclination with respect to the oppositely situated leg member, so as to form two symmetrical pairs of tongues at the opposed ends of the holder;

each pair of tongues comprising two tongues extending from said oppositely situated leg members of the holder and crossing each other at said central region;

each of said pairs of resilient tongues constituting an irreversible locking element for one of the catch elements of the strip element which is introduced from opposite sides into the channel of the seal body between the leg members of the holder independently of the position of the holder in the body.

2. The manually closable seal as defined in claim 1, wherein:

said holder is structured as a symmetrical double open-ended receiver capable of being directly selectively mounted in said channel in any one of four different positions.

3. The manually closable seal as defined in claim 1, wherein:

said strip element comprises a metallic band.

4. The manually closable seal as defined in claim 1, wherein:

the resilient tongues of one leg member protrude from said one leg member of the holder towards the other leg member thereof and are located at the same elevational position at said one leg member; and the resilient tongues of said other leg member protruding from said other leg member and extending towards said one leg member and being located at the same elevational position at said other leg member but at a different elevational position with respect to the tongues of said one leg member.

5. The manually closable seal as defined in claim 4, wherein:

said holder contains four of said tongues.

6. The manually closable seal as defined in claim 1, wherein:

said tongues constitute cut-out and bent-out tongues formed of the material of the holder.

7. The manually closable seal as defined in claim 1, wherein:

said strip element is provided at end regions thereof with respective means defining a respective reference fracture location; and each said reference fracture location being located at a place along said strip element which, when said strip element is lockingly engaged in said seal body, is located just slightly within said seal body.

8. The manually closable seal as defined in claim 1, wherein:

each of said leg members of said holder comprises flexed portions located at end regions of the channel receiving said holder and which flexed portions are directed towards one another; and said flexed portions defining slot means through which there can just pass the catch elements of the strip element.

* * * * *